US005135118A

United States Patent [19]

Koizumi

[11] Patent Number: 5,135,118

[45] Date of Patent: Aug. 4, 1992

[54] JIB HOLD ROD SECURING DEVICE FOR CRANES

[75] Inventor: Yukio Koizumi, Akashi, Japan

[73] Assignee: Kabushiki Kaisha Kobe Seiko Sho, Kobe, Japan

[21] Appl. No.: 588,849

[22] Filed: Sep. 27, 1990

[30] Foreign Application Priority Data

Mar. 16, 1990 [JP] Japan ..... 2-67917

[51] Int. Cl.[5] ..... B66C 23/04; B66C 23/64; B66C 23/42; B66C 23/00

[52] U.S. Cl. ..... 212/267; 212/266; 212/168; 212/188

[58] Field of Search ..... 212/168, 187, 188, 266, 212/267

[56] References Cited

U.S. PATENT DOCUMENTS 4,595,108 6/1986 Koizumi et al. ..... 212/168
4,653,655 3/1987 Rathi et al. ..... 212/188
4,923,071 5/1990 Koizumi ..... 212/187

FOREIGN PATENT DOCUMENTS 0084981 1/1983 European Pat. Off. .
2018089 4/1969 Fed. Rep. of Germany .
2138086 12/1972 France .
2370677 6/1978 France .
8303816 11/1983 World Int. Prop. O. .

*Primary Examiner*—Jesus D. Sotelo
*Assistant Examiner*—Kenneth Lee
*Attorney, Agent, or Firm*—Oblon, Spivak, McClelland, Maier & Neustadt

[57] ABSTRACT

A crane having a boom and a jib swingable on the boom between a taken in position and a stretched out position includes a jib holding construction. A jib hold rod is movably mounted on the jib between a first position in which a base end of the jib hold rod is connected to the jib when the jib is in the taken in position, and a second position in which the base end of the jib hold rod is connected to a portion of the boom for supporting the jib in the stretched out position. A rod holding link is mounted to the jib for selectively holding the base end of the jib hold rod at a correct position for connection to the boom when the jib is swung out to the stretched out position. This avoids the need to manually locate the jib hold rod in the second position when the jib is stretched out.

8 Claims, 6 Drawing Sheets

JIB HOLD ROD SECURING DEVICE FOR CRANES

BACKGROUND OF THE INVENTION

1. Field of the Invention

This invention relates to a jib hold rod securing device to reposition or change the position of the base end of a jib hold rod (or a desired suspension rod) holding a jib when in its stretched out position between the top portion of a boom and the base end of the jib in a manner to match the jib in its stretched-out and take-in positions.

2. Description of the Related Art

In FIGS. 7 and 8, numerals 1, 2 and 3 represent an upper rotary body of a crane, a boom liftably mounted to the upper rotary body and a jib (a pneumatic jib), respectively.

When not in use, the jib 3 is taken in and held under the lower surface of the boom in a desired manner as shown in FIG. 7 with imaginary lines and, for its lift-up operation, stretched out to the position of the top portion of the boom as described hereinbelow.

(I) Jib feet 3*a* provided on the two sides of the end portion of the jib are engaged and linked with point pins 4 provided on the two sides of a boom head 2*a* and, with an auxiliary hook 5 engaged to the top portion of the jib, an auxiliary rope 6 is taken up while the boom 2 is lifted up. Thus, the jib 3 is swung forward with the engagement linkage as its fulcrum, as shown in FIG. 7 with imaginary lines.

(II) After the boom is turned back down almost horizontally and, with the jib 3 left supported by the auxiliary hook 5 and the auxiliary take-up rope 6, a pair of right and left jib hold rods 7 and 7 are laid so as to bridge between the boom head 2*a* and the top portion of the jib to support the jib 3 in its stretched-out position as shown in FIGS. 7 and 8 with solid lines; the auxiliary rope 6 is then loosened.

As shown in FIGS. 7 and 8 with chain lines, the jib hold rods 7 are initially fixed to the jib 3 with their top portions and base portions pinned down to the top portion and base portion of the jib, respectively.

When the jib is stretched out, both of the rods 7 have their base portions released from the base portion of the jib and shifted upward so that their top portions are fixed to the top portion of the jib serving as their fulcrum, to have their base portions fixed to the summit portion of the boom head 2*a* as shown in FIGS. 7 and 8 with solid lines.

According to the conventional technology, however, it was not possible to adjust the position of a jib in a manner to match its stretched-out and taken-in state, allowing:

a. The base portion of a rod to be released from either of the base portion of the jib and the boom head 2*a*; and b. The heavy rod 7 weighing roughly 20 kgs to be lifted up and down and its base portion to be pinned down.

All the above-described operations have conventionally needed to be carried out only when the jib is in its stretched-out position as shown in the two drawings with solid lines. Thus, the conventional technology inevitably requiring high-elevation work standing on a stepladder as shown in FIG. 7 or on the jib 3, forces stress on workers engaged in such a jib repositioning and exposes them to a danger and risk.

Against the above-described background, the present invention has as its purpose to provide a jib hold rod securing device for cranes such as a jib repositioning with less danger and risk as well as labor.

The above, and other objects, are achieved according to the present invention by a crane having a boom and a jib swingable on the boom between a taken in position and a stretched out position. A jib holding construction includes a jib hold rod movably mounted on the jib between a first position in which the base end of the jib hold rod is connected to the jib when the jib is in the taken in position, and a second position in which the base end of the jib hold rod is connected to a portion of the boom for supporting the jib in the stretched out position. The rod holding means are mounted to the jib and are independent of the boom for selectively moving the base end of the jib hold rod at a correct position for connection to the boom when the jib is swung to the stretched out position.

According to an embodiment of the invention, the rod holding means comprises a link selectively connected between the base end of the jib hold rod and the jib.

According to another embodiment of the invention, the rod holding means comprises a link selectively connected between the base end of the jib hold rod and the jib.

According to another embodiment of the invention, the jib hold means comprises a bracket on the base end of the jib hold rod, the bracket having an elongate slot. A link has one end swingably mounted to the jib and another end slidably mounted in the slot. Means are provided for selectively holding the another end of the link in a portion of the slot such that the base end of the jib hold rod is at the correct position for connection to the boom.

According to another embodiment of the invention, the link is articulated at a mid-portion, whereby the link can bend about the articulation to move the jib hold rod between the first and second positions. Means are also provided for holding the link such that the jib hold rod is in the second position, the holding means comprising a gas spring mounted between the jib and the link.

According to yet a further embodiment, the rod holding means comprises a variable length link connected between the jib and the base end of the jib hold rod, the variable length link comprising a gas spring.

A jib hold rod securing device for cranes according to an aspect of the present invention makes it possible to preset the jib hold rod in its jib holding position with the use of the rod holding means at a stage of jib stretching-out operation where the jib is still operable from the ground before stretched out and thus allows laborious rod shifting work associated with a danger and risk to be carried out easily and safely from the ground.

A jib hold rod securing device for cranes according to another aspect of the present invention is made simple in structure with the rod holding means composed of a link and pins which, in turn, makes it low in cost and simple in handling.

A jib hold rod attaching device for cranes according to yet another aspect of the present invention is structured with the rink kept suspended between the jib and the jib holding rod which makes its handling far more easier:

A jib hold rod securing device for cranes according to another different aspect of the present invention is structured with gas springs employed as a means to hold the link in its stretched position which, under the influence of the gas springs, stretches and holds the link in its stretched position (to set the jib hold rod in its jib holding position), requiring far less labor.

A jib hold rod securing device for cranes according to yet another different aspect of the present invention employs gas springs which themselves serve as the rod holding means, requiring a far simpler structure.

DETAILED DESCRIPTION OF THE PREFERRED EMBODIMENTS

The present invention is described hereinbelow along with its preferred embodiments as shown in FIGS. 1 to 6.

FIRST EMBODIMENT (SHOWN IN FIGS. 1 AND 2)

The first preferred embodiment of the invention is described hereinbelow only with respect to differences from its conventional counterpart.

Figure 1:
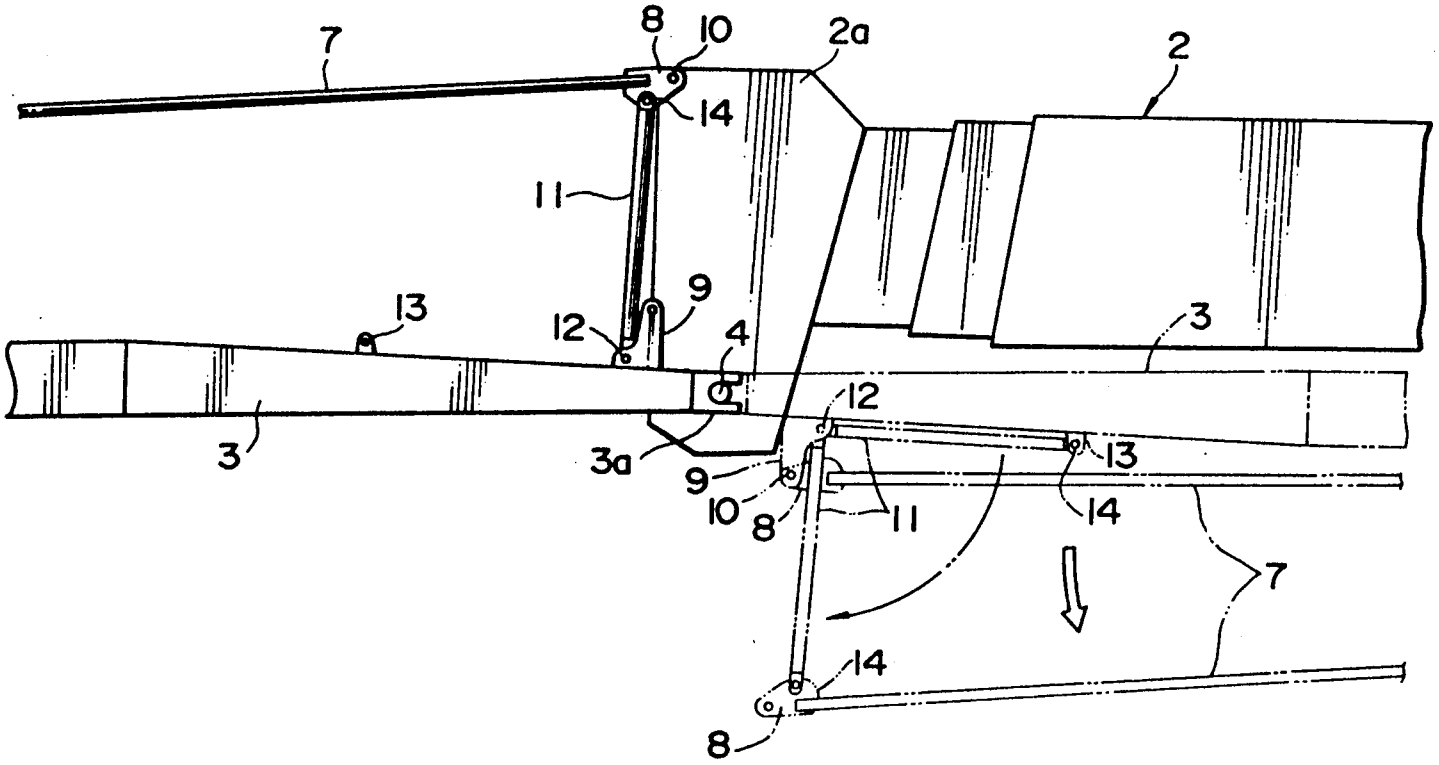
FIG. 1 is a side view of a jib hold rod attaching device representing the first embodiment of the present invention.
Figure 2:
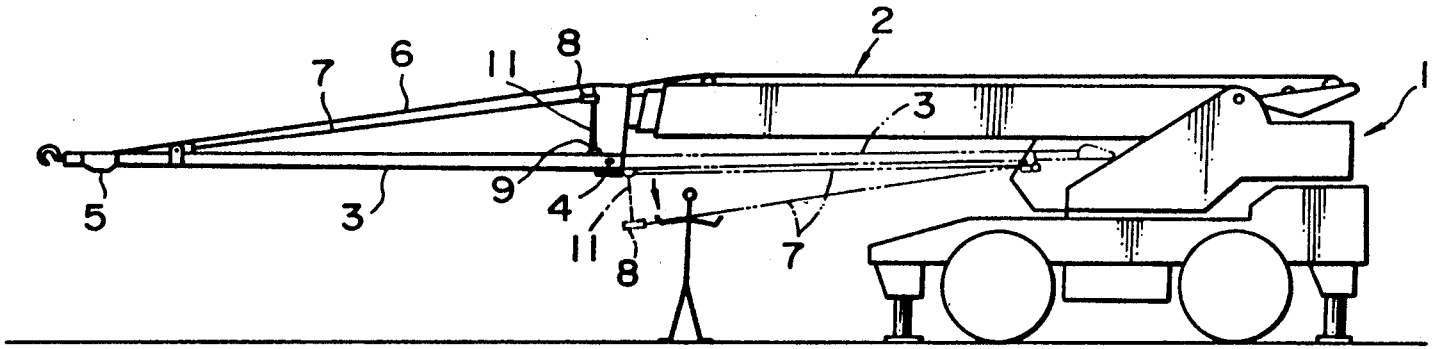
FIG. 2 is a side view of a crane equipped with the first embodiment of the present invention, outlining it in a whole.

Designated by a numeral 7 is a jib hold rod (only one is shown) having its base portion provided fixed thereto a two-pronged rod-side bracket 8 which, with a pin 10, is fixed in a first position thereof to a jib-side bracket 9 projecting under the base portion of a jib when the jib is taken in as shown in FIG. 1 with chain lines (jib-side bracket projecting over the base portion of the jib when the latter is taken out) and, in a second position thereof, to a boom head 2a when the jib is stretched out as shown in FIGS. 1 and 2 with solid lines.

The jib 3 has at its base portion right and left links 11 which, coming under the lower surface of the jib when the latter is taken in, form rod holding means.

The link 11 has its base portion pivoted to the jib-side bracket 9 with a fulcrum-side pin 12 provided through the latter horizontally so as to swing around the fulcrum-side pin 12 between its turned-down nonoperational position and its turned-up operational position almost perpendicular to the jib 3.

The link 11 has its top portion fixed with a securing pint 14 to a link securing bracket 13 provided to the jib 3 in its turned-down position and to the rod-side bracket 8 of the jib hold rod 7 in its turned-up position.

In the above-described device, the jib hold rod 7 has its position changed as described hereinbelow.

In order to get the jib stretched out, the rod-side bracket 8 of the jib hold rod 7 is released from the jib-side bracket 9 when the jib is in its taken-in position as shown in FIGS. 1 and 2 with chain lines, and the jib hold rod 7 is swung downward around the jib top engagement and linkage point serving as a fulcrum. At the same time, the link 11 is lifted to its turned-up position and the top portion of the link 11 fixed to the rod-side bracket 8 with the pin 14.

By this, the jib hold rod 7 is set in its jib holding position ready to have the jib in its stretched-out position allowing the rod-side bracket 8 to be fixed to the boom head 2a in a position as shown in FIG. 1 with solid lines.

In an operational state resulting from the above, the rod-side and jib-side brackets 8 and 9 position themselves at a height manually accessible from the ground, allowing operations to be executed easily from the ground to swing the jib downward and secure the link 11.

Even with a large crane rising high in its position, the said operations can be carried out from the ground to a satisfactory degree if its crane body (boom 2) is slightly inclined forward with an outrigger operated.

When the jib 3 is thereafter stretched out to its position as shown in FIGS. 1 and 2 with solid lines, the rod-side bracket 8 of the jib hold rod 7 shifts itself to its fixing pre-set position on the tip of the boom head 2, needing only to be fixed to the boom head 2a with the pin 10.

As the device according to the present invention requires high-elevation operations only to carry out the said pin-fixing, it makes it possible to, when the jib is in its stretched-out position, reposition or change the position of the jib hold rod more easily and with far less labor as compared with a conventional device of its kind.

When the jib is in its taken-in position, the jib hold rod is allowed to be changed or its position changed in operational order opposite to the above-described jib repositioning with the jib hold rod in its stretched-out position.

SECOND EMBODIMENT (SHOWN IN FIG. 3)

Other embodiments of the present invention are described hereinbelow with respect to their differences from the first embodiment of the invention.

In the second embodiment of the present invention, the jib hold rod 7 has provided at its base portion a rod-side bracket 16 having extending in its longitudinal direction an elongate slot 15, through which the top portion of the link 17 is fixed to the bracket 16 with the pin 14.

Figure 3:
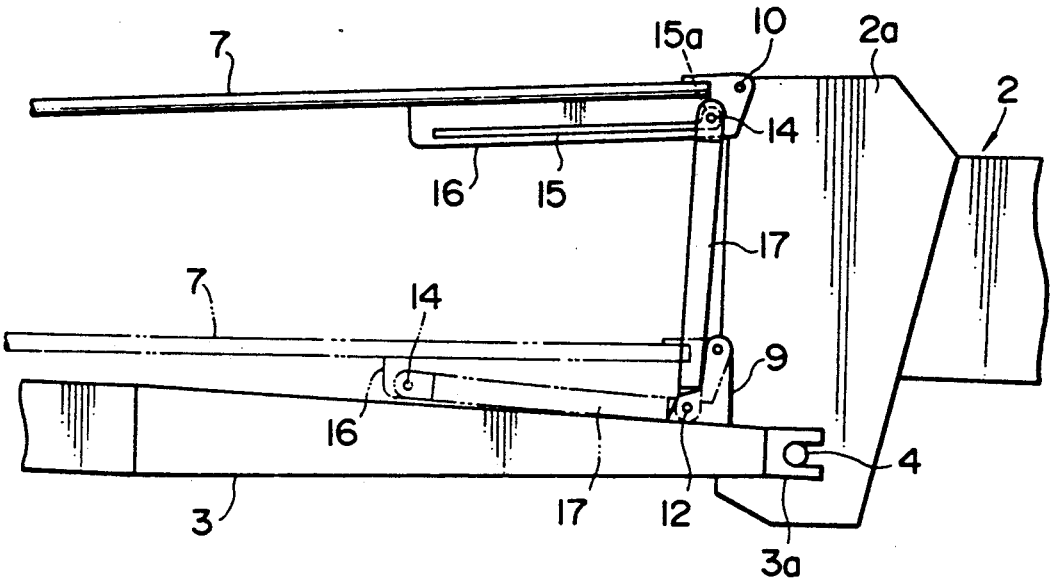
FIG. 3 is a side view of the second embodiment of the invention.
Figure 4:
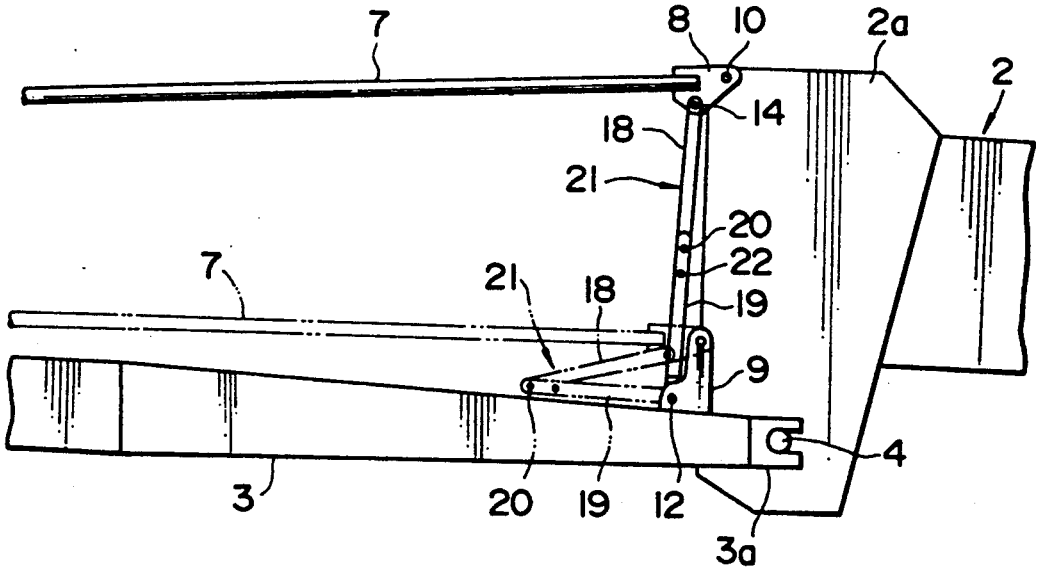
FIG. 4 is a side view of the third embodiment of the invention.
Figure 5:
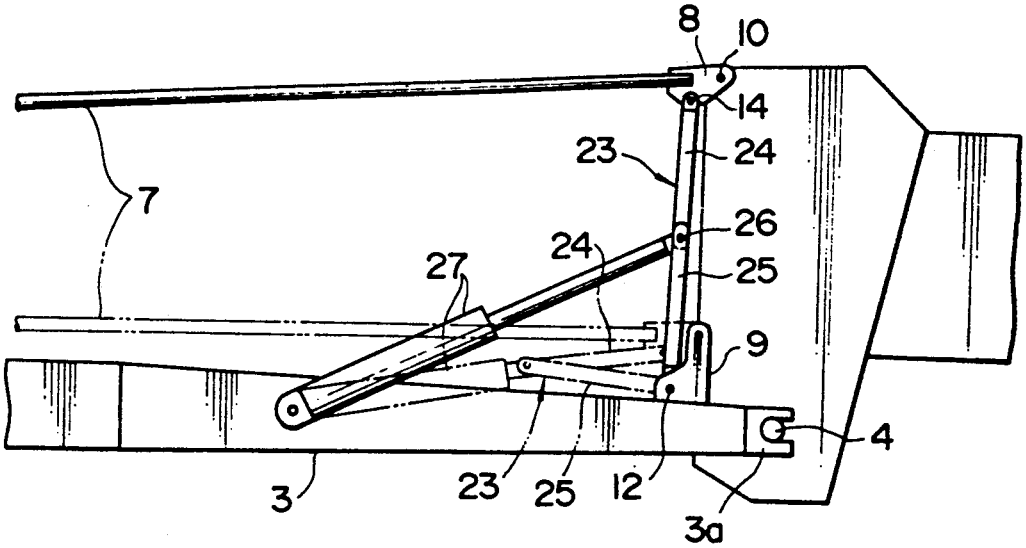
FIG. 5 is a side view of the fourth embodiment of the invention.
Figure 6:
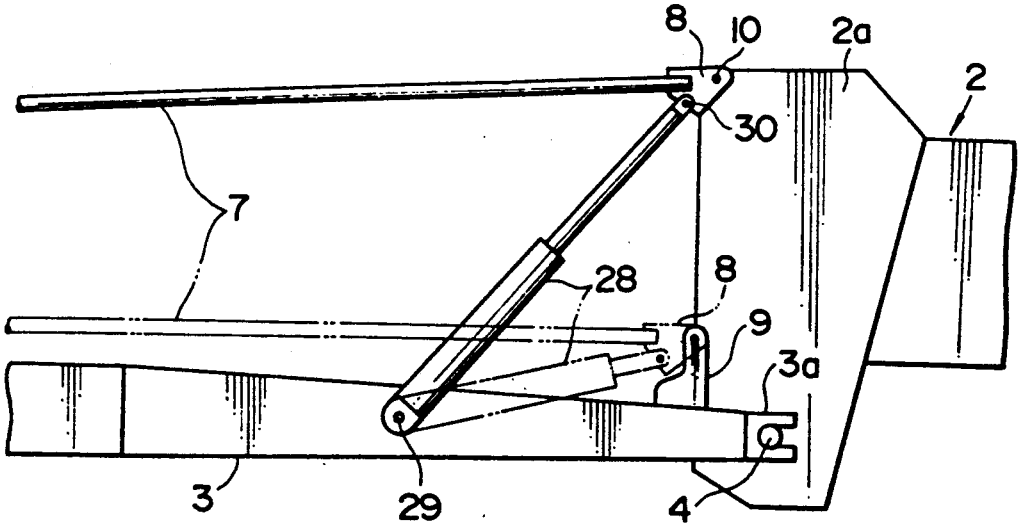
FIG. 6 is a side view of the fifth embodiment of the invention.
Figure 7:
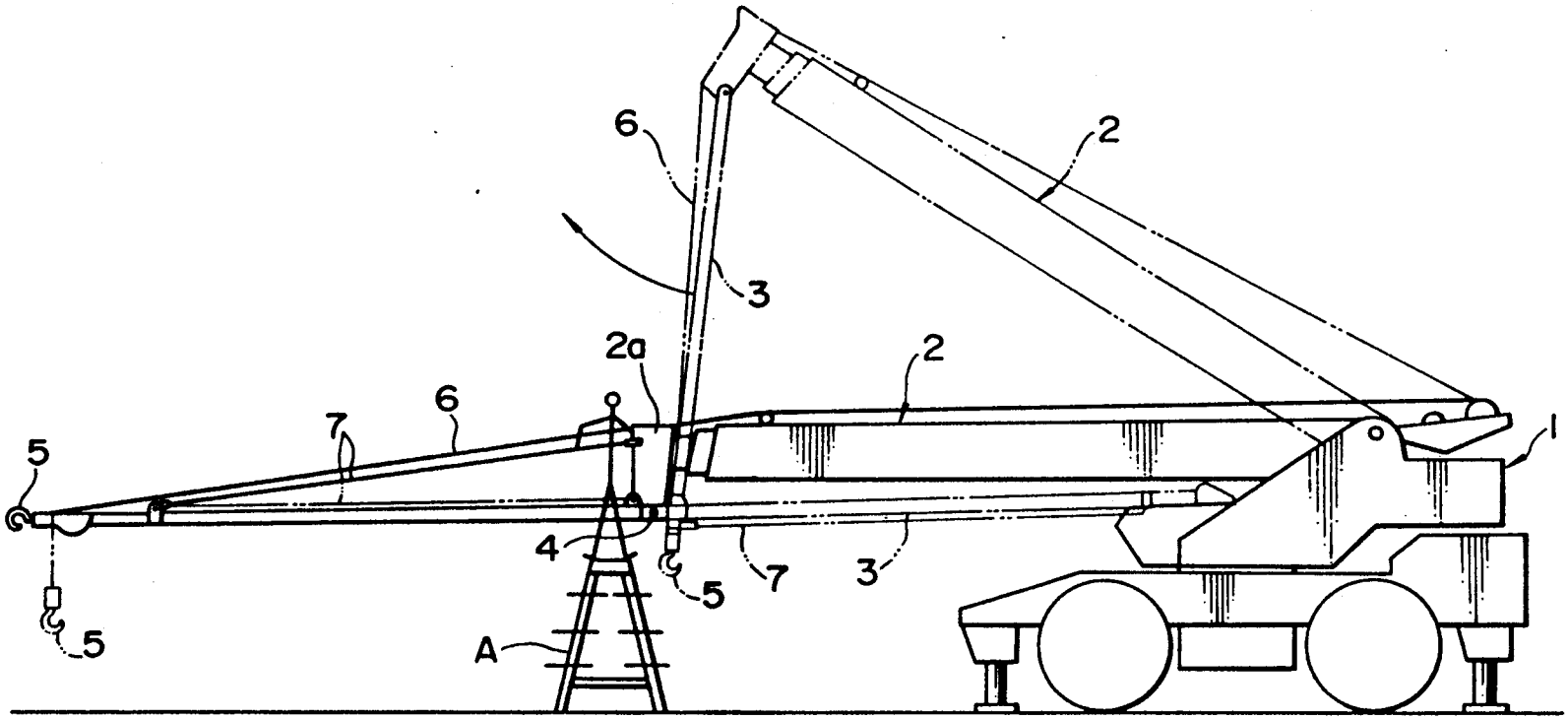
FIG. 7 is a corresponding drawing to FIG. 2, showing a conventional device of the same kind as the present invention.
Figure 8:
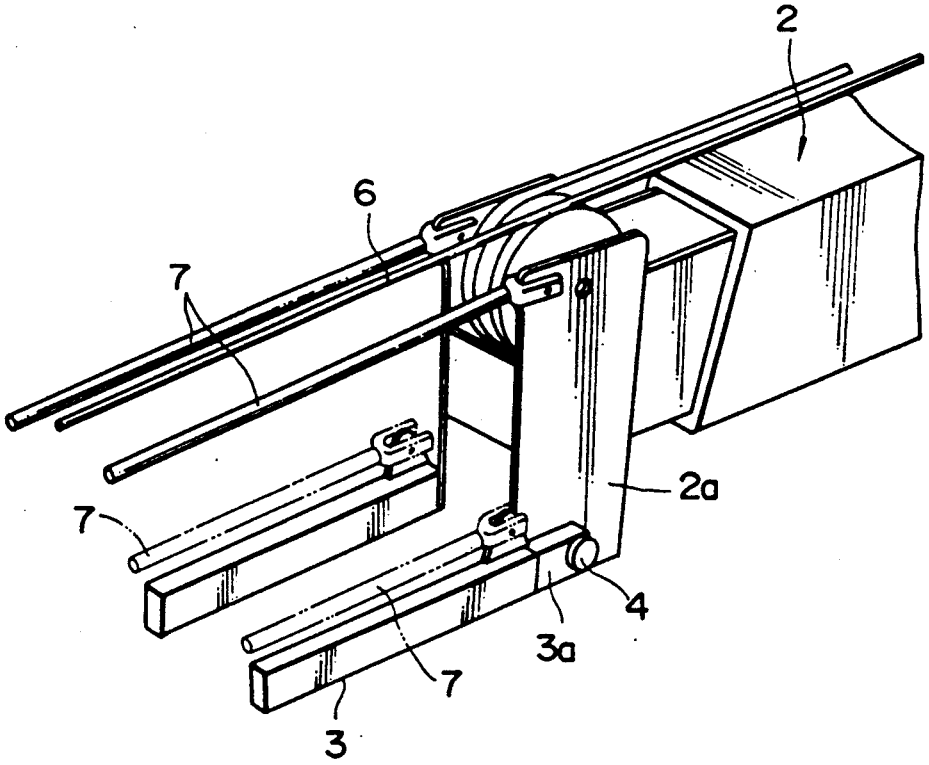
FIG. 8 is a partially-expanded view of the device shown in FIG. 7.

With the above-described structure, the link 17 takes respective positions in correspondence to the position of the jib hold rod 7 swinging between its jib holding position and jib taken-in position as shown in FIG. 3 with solid and chain lines. In order to fix the link 17 in its turned-up position, the elongate slot 15 has provided on its base portion a recess 15a to receive the pin 14 fitted therein.

In this second embodiment of the invention, the link 17 automatically shifts its position upward following the rotation of the jib hold rod 7, making a replacing of the link top portion unnecessary and the re-positioning of the jib hold rod easier.

THIRD EMBODIMENT (SHOWN IN FIG. 4)

In the third embodiment of the present invention, a pair of link elements 18 and 19 are engaged and linked together at their respective ends with a pin 20 to form a articulated collapsible (to fold and open) link 21 which is structured to articulate at its mid-portion in correspondence to the position of the jib hold rod 7 swinging between its taken-in and jib holding positions. The link 21 is kept in its stretched-out position with a lock pin provided in the vicinity of its collapsible engagement and linkage point.

FOURTH EMBODIMENT (SHOWN IN FIG. 5)

Like in the third embodiment of the present invention, the fourth embodiment of the invention has a collapsible link 23 formed with a pair of link elements 24 and 25 linked together with a pin 26. The link 23 is structured to stay straight chain (second position) under the influence of gas springs 27 suspended between the collapsible engagement and linkage point of the link and the jib 3.

With the above-described structure, the link 23 is stretched out and stays straight in its stretched-out position under the influence of the gas springs 27 (setting the jib hold rod 7 in its jib holding position), a factor which serves to reduce a work load greatly.

FIFTH EMBODIMENT (SHOWN IN FIG. 6)

In the fifth embodiment of the present invention, there are provided gas springs 28 suspended between the jib 3 and the rod-side bracket 8 of the jib hold rod 7 by the means of pins 29 and 30. The gas springs 28 are structured to serve as an extensible rod hold means to hold the jib hold rod 7 in its jib holding (second) position.

Like in the fourth embodiment of the present invention, the fifth embodiment of the invention with the above-described structure is simple in structure and requires less labor for the work required for its operation.

In the above, the present invention is described with reference to its embodiments in a crane taking in a jib under its boom. It is needless to say, however, that the invention can be employed in a desired crane of the type which takes in a jib on its side.

What is claimed is:

1. In a crane having a boom and a jib swingable on the boom between a taken in position and a stretched out position, a jib holding construction comprising:

a jib hold rod movable mounted on the jib between a first position in which a base end of the jib hold rod is connected to the jib when the jib is in the taken in position, and a second position in which the base end of the jib hold rod is connected to a portion of the boom for supporting the jib in the stretched out position; and rod holding means mounted to said jib and independent of said boom for selectively and independently holding and maintaining said base end of said jib hold rod at a correct position for connection to said boom when said jib is swung to the stretched out position.

2. The crane of claim 1 wherein said rod holding means comprises a link selectively connected between said base end of said jib hold rod and said jib.

3. The crane of claim 1 wherein said rod holding means comprises:

a bracket on said base end of said jib hold rod, said bracket having an elongate slot;

a fixed length link having one end swingably mounted to said jib and another end slidably mounted in said slot; and means for selectively holding said another end of said link in a portion of said slot such that said base end of said jib hold rod is at said correct position.

4. The crane of claim 2 wherein said link is articulated at a mid-portion thereof, whereby said link can bend about the articulation to move the jib hold rod between said first and second positions.

5. The crane of claim 4 including means for holding said link such that said jib hold rod is in said second position.

6. The crane of claim 5 wherein said holding means comprises a gas spring mounted between said jib and said link.

7. The crane of claim 1, wherein said rod holding means comprises a variable length link connected between said jib and said base end of said jib hold rod.

8. The crane of claim 7 wherein said variable length link comprises a gas spring.

* * * * *